US009257751B2

(12) United States Patent
Felic et al.

(10) Patent No.: US 9,257,751 B2
(45) Date of Patent: Feb. 9, 2016

(54) INTEGRATION OF MICROSTRIP ANTENNA WITH CMOS TRANSCEIVER

(75) Inventors: Gordana Felic, Ringwood North (AU); Stan Skafidas, Thornbury (AU)

(73) Assignee: Nitero Pty Limited, Fitzroy (AU)

( * ) Notice: Subject to any disclaimer, the term of this patent is extended or adjusted under 35 U.S.C. 154(b) by 1249 days.

(21) Appl. No.: 12/920,053

(22) PCT Filed: Mar. 13, 2009

(86) PCT No.: PCT/AU2009/000302

§ 371 (c)(1),
(2), (4) Date: Apr. 5, 2011

(87) PCT Pub. No.: WO2009/111839

PCT Pub. Date: Sep. 17, 2009

(65) Prior Publication Data

US 2011/0260943 A1 Oct. 27, 2011

(30) Foreign Application Priority Data

Mar. 14, 2008 (AU) ..... 2008901258

(51) Int. Cl.
*H01Q 9/04* (2006.01)
*H01Q 1/50* (2006.01)
(Continued)

(52) U.S. Cl.
CPC ..... *H01Q 9/045* (2013.01); *H01Q 23/00* (2013.01); *Y10T 29/49018* (2015.01)

(58) Field of Classification Search
CPC ..... H01Q 9/04
USPC ..... 343/860
See application file for complete search history.

(56) References Cited

U.S. PATENT DOCUMENTS 4,259,670 A 3/1981 Schiavone
5,392,152 A 2/1995 Higgins et al.
(Continued)

FOREIGN PATENT DOCUMENTS

EP 0 447 218 9/1991
EP 1 304 762 4/2003

OTHER PUBLICATIONS

Huang et al. ("60 GHz On-Chip Patch Antenna Integrated in a 0.13-μm CMOS Technology". Proceedings of 2010 IEEE International Conference on Ultra-Wideband (ICUWB2010); p. 1-4, Date of Conference Sep. 20-23, 2010).*
(Continued)

*Primary Examiner* — Dameon E Levi
*Assistant Examiner* — Andrea Lindgren Baltzell
(74) *Attorney, Agent, or Firm* — Hickman Palermo Becker Bingham LLP

(57) ABSTRACT

A monolithic antenna element comprises a microstrip patch antenna and a ground plane, with a substrate between the patch antenna and the ground plane. A feeding via extends from the ground plane layer through the substrate to the patch antenna, connecting to the antenna distal from lateral edges of the antenna. A coplanar waveguide (CPW) feed line is formed in the ground plane layer, and interrupts and is electrically distinct from the ground plane. The CPW extends from a lateral edge of the ground layer to the feeding via. The antenna can be flip chip bonded to a CMOS die, reducing cost of millimeter wave transceivers, e.g. 57-64 GHz. The antenna is fabricated using standard PCB technology and a single substrate for the antenna. Antenna arrays can be fabricated. Appropriately designed antenna feeds, flip chip interconnects and antenna shape provide suitably broad antenna bandwidth, with relatively high efficiency.

17 Claims, 7 Drawing Sheets

(51) Int. Cl.
*H01P 11/00* (2006.01)
*H01Q 23/00* (2006.01)

(56) References Cited

U.S. PATENT DOCUMENTS

| | | | | |
|---|---|---|---|---|
| 5,903,239 | A | 5/1999 | Takahashi et al. | |
| 6,822,528 | B2 * | 11/2004 | Dawn et al. | 333/26 |
| 7,196,666 | B2 | 3/2007 | Allen et al. | |
| 7,980,477 | B2 * | 7/2011 | Finn | 235/492 |
| 2006/0017650 | A1 | 1/2006 | Allen et al. | |

OTHER PUBLICATIONS

A Babakhani, X Guan, A Komijani, A Natarajan, and A.Hajimiri, "A 77-GHz Phased-Array Transceiver with On-Chip antennas in silicon: Receiver and Antennas," IEEE J. Solid-State Circuits, vol. 41, No. 12, pp. 2795-2806, Dec. 2006.*

C.H. Doan et al., "Design of CMOS for 60 GHz Applications", Berkeley Wireless Research Center, Department of EECS, University of California, Berkeley, Feb. 2004, 27 pages.

Jeong-Geun Kim et al., "60-Ghz CPW-Fed Post-Supported Patch Antenna Using Micromachining Technology", IEEE Microwave and Wireless Components Letter, vol. 15, No. 10, Oct. 2005, pp. 635-637.

Steven Mestdagh et al., "CPW-Fed Stacked Microstrip Antennas", IEEE Transactions on Antennas and Propagation, vol. 52, No. 1, Jan. 2004, pp. 74-83.

H.R. Chung et al., "A 60 GHz Millimeter-wave CMOS RFIC-on-chip Dipole Antenna", Technical Issue, Jan. 17, 2007, 10 pages.

Ching-Kuang C. Tzuang et al., "CMOS RF SoC design shoots for 60 GHz", EETimes.com, May 3, 2008, 3 pages.

Chinh H. Doan et al., "Design of CMOS for 60GHz Applications", 2004 IEEE International Solid-State Circuits Conference, Jun. 2004, 10 pages.

Y.P. Zhang et al., "On-Chip Antennas for 60-GHz Radios in Silicon Technology", IEEE Transactions on Electron Device, vol. 52, No. 7, Jul. 2005, pp. 1664-1668.

G. Felic et al., "A Microstrip Antenna for 60-GHz CMOS Transceiver System in a Package", 2008 Asia-Pacific Symposium on Electromagnetic Compatibility & 19$^{th}$ International Zurick Symposium on Electromagnetic Compatibility, May 29-22, 2008, pp. 323-326.

Y.P. Zhang, "Integration of Microstrip Patch Antenna on Ceramic Ball Grid Array Package", Electronics Letters, vol. 38, Issue 5, Feb. 28, 2002, pp. 207-208.

Y.P. Zhang, "Integration Circuit Cofired Laminated Ceramic Package Antenna", Solid-State and integrated-Circuit Technology, 2001, Proceedings, 6$^{th}$ International Conference, vol. 1, Oct. 2001, pp. 100-103.

PCT International Search Report and Written Opinion of the International Searching Authority, International Application No. PCT/AU2009/000302, filed Mar. 13, 2009, Australian Patent Office, Jun. 2009, 11 pages.

* cited by examiner

INTEGRATION OF MICROSTRIP ANTENNA WITH CMOS TRANSCEIVER

CROSS-REFERENCE TO RELATED APPLICATIONS

The present application claims priority from Australian Provisional Patent Application No 2008901258 filed on 14 Mar. 2008, the content of which is incorporated herein by reference.

TECHNICAL FIELD

The present invention relates to integration of a microstrip antenna upon a CMOS die, and in particular relates to a fully integrated CMOS millimeter-wave wireless transceiver comprising such an antenna.

BACKGROUND OF THE INVENTION

There exists a large allocated bandwidth around the 60 GHz region of the spectrum, offering the appeal of high-speed short distance wireless personal area networks (WPANs), radar applications such as automotive radar, along with other potential industrial, scientific and medical applications. This has motivated research into low cost, efficient and small form factor integrated millimeter-wave devices in order to facilitate their use in consumer electronic (CE) applications. Wireless systems operating at such millimeter-wave frequencies require appropriate antennas.

One approach to fabricating antennas having adequate operational bandwidth and efficiency for such applications has been to utilise micromachining technology to construct a post-supported antenna, together with a coplanar waveguide (CPW) antenna feed. Such antennas comprise an air dielectric rather than a silicon substrate dielectric, which increases bandwidth and improves radiation efficiency. However, micromachining is not compatible with standard CMOS technology, increases costs, and may raise doubts as to mechanical stability. A further significant issue in fabrication of such antennas can be transition discontinuity losses at connections between the antenna and other transceiver elements.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

According to a first aspect the present invention provides a monolithic antenna element comprising:

- a microstrip patch antenna formed on a first surface of a substrate;
- a ground plane formed on or adjacent to a second surface of the substrate substantially opposite the first surface, such that the substrate is between the patch antenna and the ground plane;
- a feeding via extending from the second surface through the substrate to the first surface and being electrically connected to the microstrip patch antenna in a location distal from lateral edges of the microstrip patch antenna; and
- a coplanar waveguide feed line formed on or adjacent to the second surface of the substrate and interrupting and being electrically distinct from the ground plane, and extending from proximal to a lateral edge of the second surface to the feeding via.

According to a second aspect the present invention provides a monolithic transceiver comprising at least one antenna element in accordance with the first aspect flip chip mounted upon a CMOS die comprising active devices.

Embodiments of the second aspect of the invention may comprise a plurality of antenna elements flip chip mounted upon the CMOS die.

According to a third aspect the present invention provides a method of fabricating a monolithic antenna element, the method comprising:

- forming on a first surface of a substrate a microstrip patch antenna;
- forming on or adjacent to a second surface of the substrate substantially opposite the first surface a ground plane, such that the substrate is between the patch antenna and the ground plane;
- forming a feeding via extending from the second surface through the substrate to the first surface and being electrically connected to the microstrip patch antenna in a location distal from lateral edges of the microstrip patch antenna; and
- forming on or adjacent to the second surface of the substrate a coplanar waveguide feed line interrupting and being electrically distinct from the ground plane, and extending from proximal to a lateral edge of the second surface to the feeding via.

Embodiments of the present invention may thus provide a broad band, efficient antenna for a millimeter-wave wireless transceiver system, giving low cost integration by being compatible with CMOS technology and may also be compatible to other technologies such as SiGe or GaAs, and providing low interconnection losses. Moreover, the use of an under-fill layer with flip chip bonding assists in providing mechanical stability.

By selecting flip-chip bonding, this invention provides on chip antenna integration bonding which is compatible with standard CMOS technology, and which avoids the significant transition discontinuity losses suffered by wire bonding and wedge bonding at millimeter wave frequencies. Moreover, flip chip mounting enables a low loss connection between the coplanar waveguide formed on the second surface to a microstrip transmission line or other type of connection as may be formed upon a CMOS die upon which the antenna element is flip chip mounted.

Moreover, by feeding the antenna patch by a feeding via, the feed signal may be delivered to the patch at any desired location, and in preferred embodiments the location at which the feeding via is connected to the patch antenna is predetermined in a manner to effect input impedance matching, such as 500 impedance matching.

In embodiments in which circular polarisation is desired, the patch antenna is preferably substantially square shaped. In such embodiments impedance matching may be effected by locating the feeding via substantially upon one diagonal of the square.

The ground layer may be formed on the second surface of the substrate, prior to flip chip mounting of the substrate upon a CMOS die. Alternatively, the ground layer may be formed on a CMOS die and positioned adjacent to the second surface of the substrate by flip chip mounting of the substrate upon the CMOS die.

Preferably, a size and position of the metallic bumps upon the CMOS die to effect a flip chip interconnect is selected in order to optimise the antenna characteristics for an intended purpose.

BRIEF DESCRIPTION OF THE DRAWINGS

An example of the invention will now be described with reference to the accompanying drawings, in which.

DESCRIPTION OF THE PREFERRED EMBODIMENTS

Figure 1:
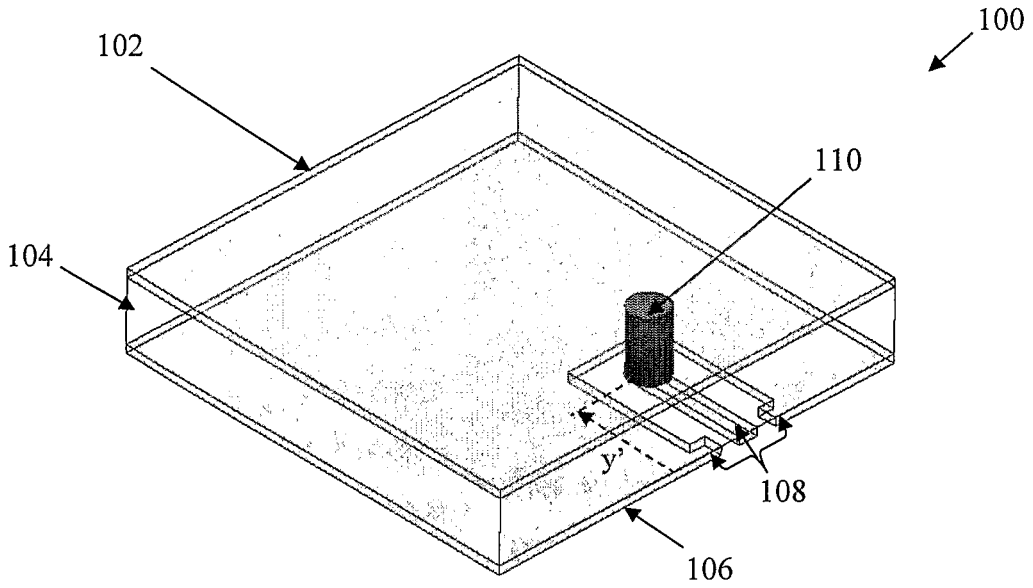
FIG. 1 illustrates an antenna element in accordance with one embodiment of the present invention.

The basic geometry of a microstrip antenna element 100 in accordance with one embodiment of the invention is shown in FIG. 1. The antenna is comprised of a radiating patch 102 printed on the upper surface of the substrate 104, and a ground plane 106 printed on the underside of the substrate 104. The substrate 104 is Rogers 5880 which is a low dielectric loss substrate having low dielectric constant. In order to achieve circular polarisation and 50-Ω input impedance matching the shape of the antenna patch 102 is nearly square. The radiating antenna patch 102 on the top surface of the substrate 104 is connected to the signal input on a bottom edge of the substrate 104 by way of a coplanar waveguide (CPW) line 108 extending from the signal input along the underside of the substrate 104 through an interruption in the ground patch/plane 106. The CPW line 108 leads to a feed via 110 extending through the substrate 104, with the feed location selected along the diagonal starting at the lower right corner of the square shape of the antenna patch 102. This type of connection allows the antenna 100 to be fabricated by using standard PCB and flip-chip bonding technology.

FIG. 2*a* is an enlarged view of a portion of the antenna element 100 of FIG. 1, showing flip-chip interconnections between coplanar waveguide feed lines 118 on CMOS die and 108 on the antenna element 100. The metallic (gold) bumps 112, placed on the CMOS die pads through a modification of the "ball bonding" process, provide for flip chip connection of the pads and transmission line of the CMOS die 120 with the antenna input pads. In order to mechanically support the antenna structure 100 an under-fill dielectric layer 114 is placed in the gap between the antenna element 100 and CMOS die 120.

Figure 2:
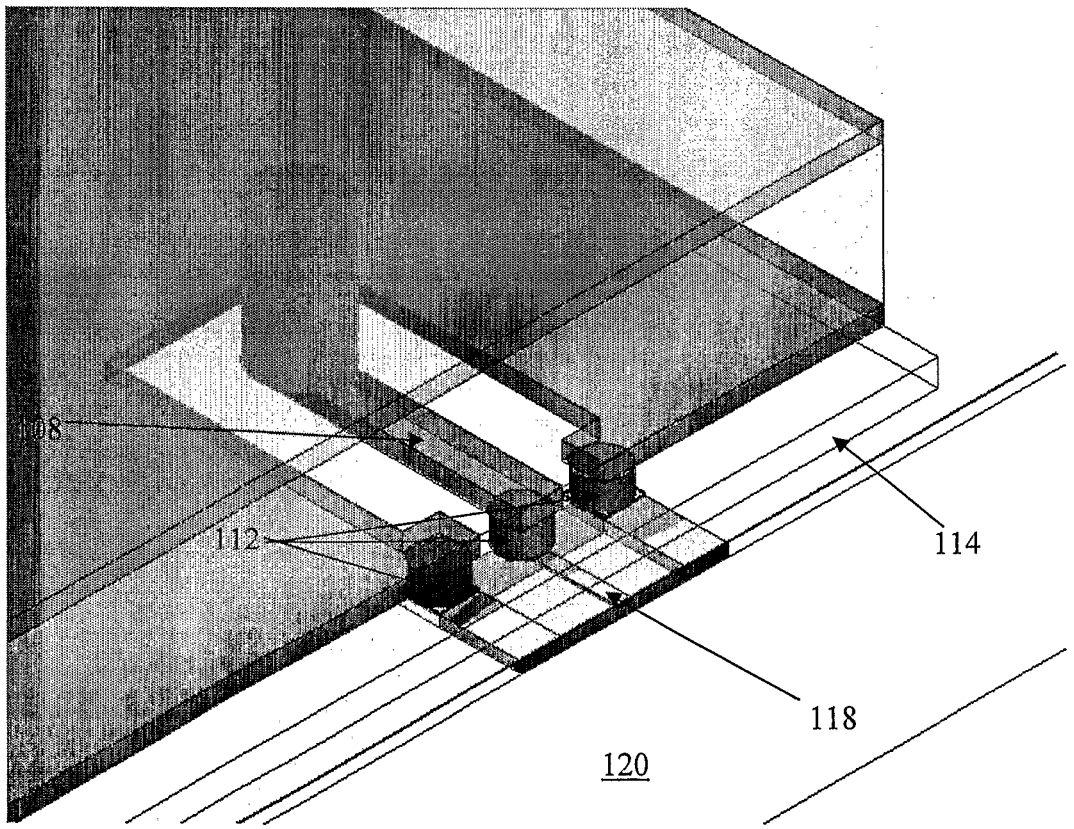
FIG. 2 is an enlarged view of a portion of the antenna element of FIG. 1, showing flip-chip interconnections between coplanar waveguide feed lines on CMOS die and on the antenna element.
Figure 3A:
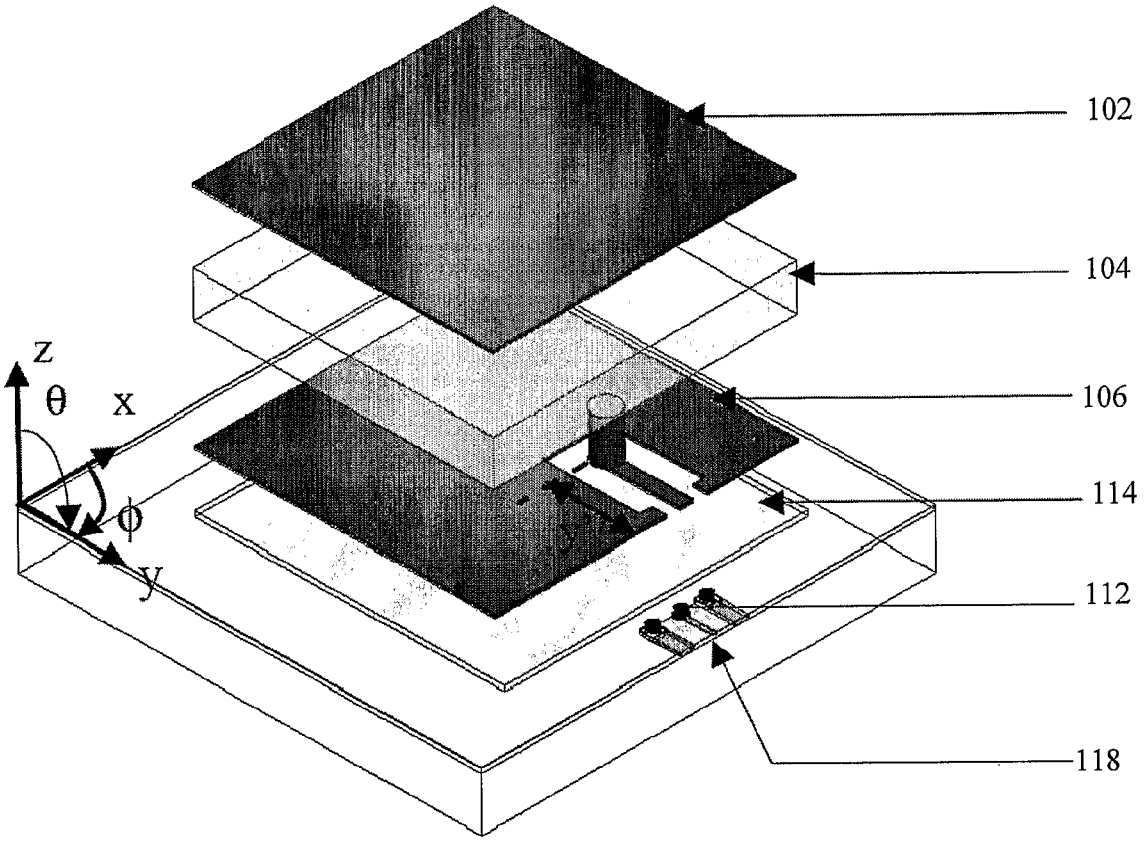
FIG. 3*a* is an exploded perspective view of the patch antenna structure on CMOS.
Figure 3B:
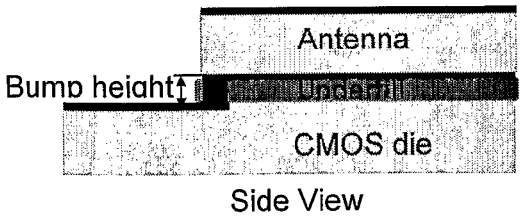
FIG. 3*b* gives a cross sectional side view of the antenna construction and FIG. 3*c* gives a cross sectional top view detail of the flip-chip transition region.
Figure 3C:
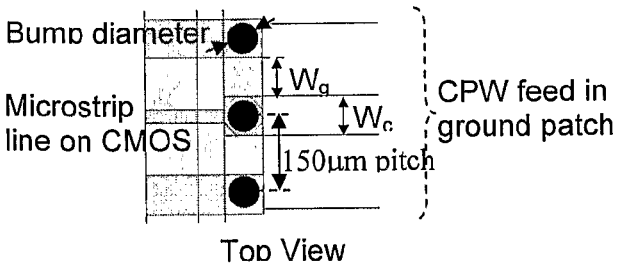

FIG. 3*a* is an exploded view of the embodiment of FIGS. 1 and 2. In this geometry of the fabricated antenna, the parameters were: antenna length l=1.65 mm, antenna width w=1.67 mm, substrate $\in_r$=2.2, via to edge spacing y'=0.435 mm, and substrate height $h_s$=0.254 mm. FIG. 3*b* gives a cross sectional side view of the antenna construction and FIG. 3*c* gives a cross sectional top view detail of the flip-chip transition region. To attach the antenna element 100 to the CMOS die 120 and form flip-chip interconnections, a thermo-sonic flip chip attachment process is used. The thermo-sonic attachment process uses heat, pressure and ultrasonic energy to form a bond between each bump 112 and metallisation surface. The embodiment of FIGS. 1 to 3 thus employs flip-chip bonding (solder balls) to connect the antenna 100 to the die 120. This technology uses metallic bumps 112 for device connections which are kept small (less than 100 μm) compared to the length of bond wire and results in better impedance matching and reduces interconnection losses.

The optimized design of the antenna 100 in this embodiment includes interconnections optimisation. The design value for bump diameter is 60 μm, the permittivity of underfill layer is 4.1 (Epotek, U300) and bump height is 20 μm. However, a 20 μm bump height was not achievable in the manufacturing process used (stud bump technology) and the final fabricated bump height was 40 μm (±5 μm tolerance). Parameters studied were the bump height, bump diameter and permittivity of the underfill layer. Other parameters such as the bump pitch and parameters of microstrip line on CMOS are predetermined by the chosen technology and required 50-Ω output impedance of the chip design.

It is further noted that fabrication capabilities and tolerances of the particular bump technology may affect antenna performance; reduce the gain and narrow input impedance bandwidth. Also, electrical properties of the underfill material 114 such as permittivity and dielectric loss have an impact on antenna performance. Accordingly, the antenna-chip structure 100 of this embodiment was simulated with the finite element method software HFSSv11 from Ansoft Corporation. The definition of impedance bandwidth that is used for this study is given by $$BW = \frac{(f_H - f_L)_{\Gamma=-10db}}{f_0} \quad (1)$$

where Γ is the return loss, $f_0$ is centre frequency, $f_L$ is lower frequency and $f_H$ is the highest frequency at which the return loss is equal to −10 dB. The antenna radiation efficiency is calculated from the ratio between the radiated power and accepted power where the accepted power is a measure of the incident power reduced by the mismatch loss at the antenna input port.

Figure 4A:
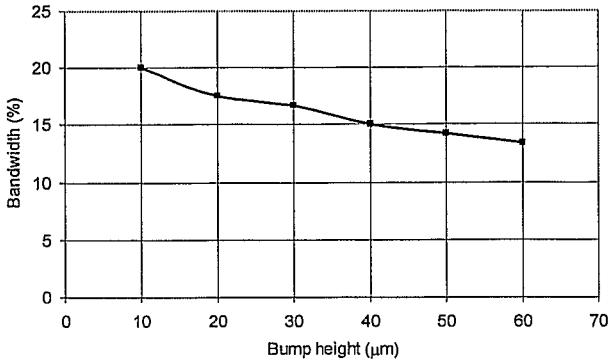
FIG. 4 illustrates simulated results of varying the bump and underfill height: (a) bandwidth, (b) gain at 60-GHz frequency.
Figure 4B:
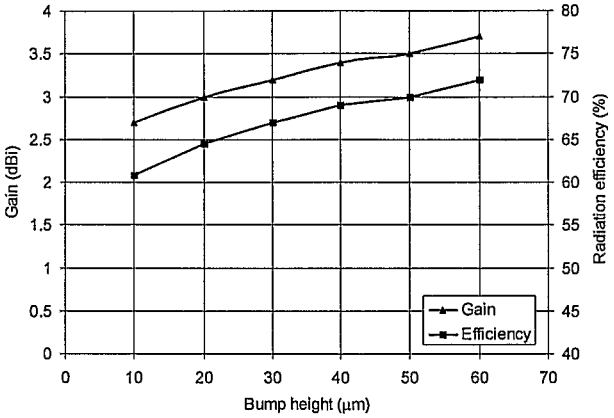

Firstly, the effect of the coplanar bumps 112 on the performance of antenna 100 was investigated by varying the bump height while keeping the bump diameter constant and equal to 60 μm. The thickness of the underfill layer 114 is simultaneously changed in the same increment as the bump height. FIG. 4 displays the effect of the bump height on the input impedance bandwidth when the heights are altered by 10 μm. The maximum bandwidth is achieved using the shortest metallic bumps. The bandwidth is reduced from 20% to 15% for the height variation from 10 μm to 40 μm. Further increasing the bump height from 40 μm to 60 μm, reduces the bandwidth further from 15% to 13%. The gain and efficiency at 60 GHz increase from 2.7 dBi to 3.7 dBi and from 60.8% to 72%, respectively. A similar trend of gain and radiation efficiency increase occurs through the entire bandwidth. This indicates that the increase of bump height and underfill thickness increases antenna quality factor which is proportional to the radiation efficiency.

Figure 5:
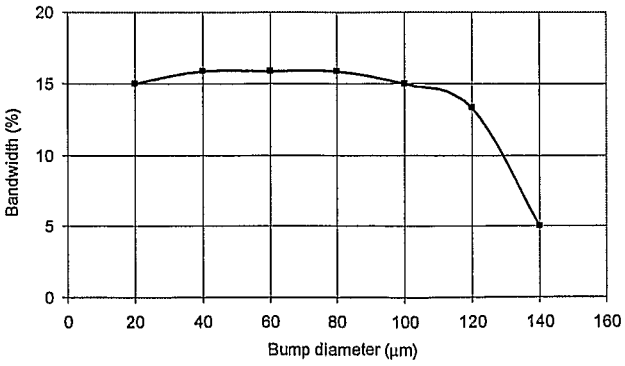
FIG. 5 illustrates simulated results of varying the bump diameter at 60 GHz frequency.

The relationship of bump diameter to bandwidth was also investigated. The expected range of the bump diameters after fabrication process is from 60-80 μm which is in the order of the pads size on CMOS. The control over bump diameter during the bonding process obtains smooth transition from the CMOS pads to the antenna feed line 108 and achieves lowest return loss. FIG. 5 displays the effect on bandwidth when the bump diameters are altered from 20 to 140 μm. The height of the bumps 112 and underfill layer 114 are kept constant and equal to 40 μm. The maximum bandwidths are achieved with diameter from 40 to 80 μm. The gain and efficiency at 60 GHz are constant for the whole range of bump diameters from 20 to 140 μm.

Figure 6A:
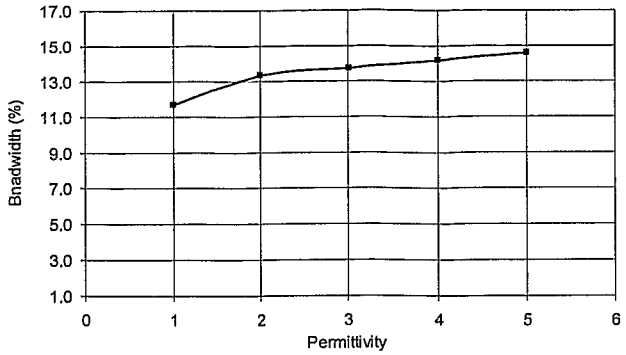
FIG. 6 illustrates simulated results of varying the permittivity of underfill substrate on (a) bandwidth, (b) gain and radiation efficiency at 60 GHz frequency.
Figure 6B:
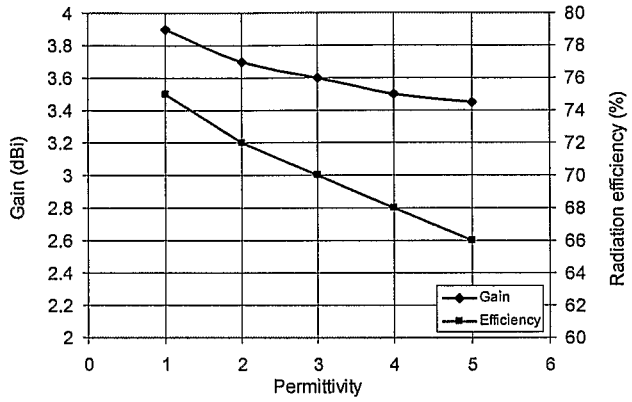

The relationship of underfill permittivity to the bandwidth and gain was also investigated. The investigation of the effects of underfill layer 114 on the antenna bandwidth and gain is carried out for typical bump height of 40 μm and bump diameter of 80 μm. The known permittivity for most of commercially available underfill materials spans from 3 to 4.4 (e.g. Hysol, Locate). FIG. 6 displays the effect on the antenna bandwidth when the permittivity constants are altered from 1 to 5. The absence of underfill layer 114 between the patch and chip (i.e. $\in_r=1$) decreases the bandwidth since low permittivity increases impedance of the bump interconnection and feed CPW line 118 that causes input impedance mismatch and narrows the bandwidth. The bandwidth increases for 2.5% when the permittivity is altered from 2 to 5. The efficiency and gain at 60 GHz are reduced from 75% to 68% and 3.8 dBi to 3.5 dBi respectively.

Figure 7:
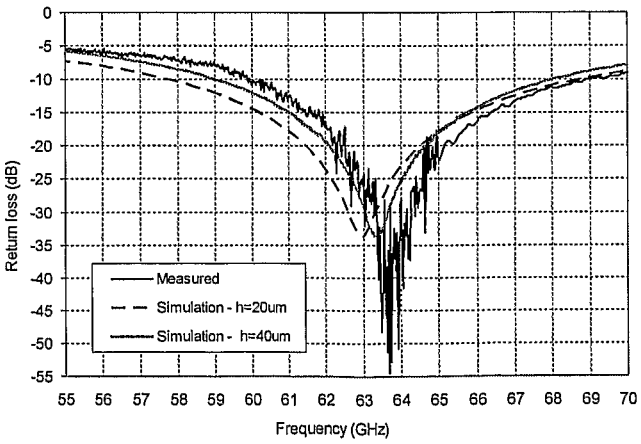
FIG. 7 illustrates measured return loss performance of an integrated antenna with flip-chip interconnect. (Simulation parameters: $\in_r$=4.1, bump diameter=60 μm)

Measurement results were also obtained from an actual fabricated antenna. FIG. 7 shows the simulated and measured input return losses of the fabricated antenna with flip-chip interconnection. The return loss was measured on a probe station using a GSG probe. In the frequency band from 60 GHz to 69 GHz, measured return losses lower than −10 dB were achieved (15% bandwidth). Simulation results show that when the bump height increases from 20 to 40 μm the −10 dB bandwidth decreases by 1.5 GHz. This is due to the increased impedance (reactance) of extended bump length which increases input impedance mismatch. To fully cover the 57-66 GHz band this reactance can be compensated by redesign of the antenna 100 with larger patch size.

Figure 8:
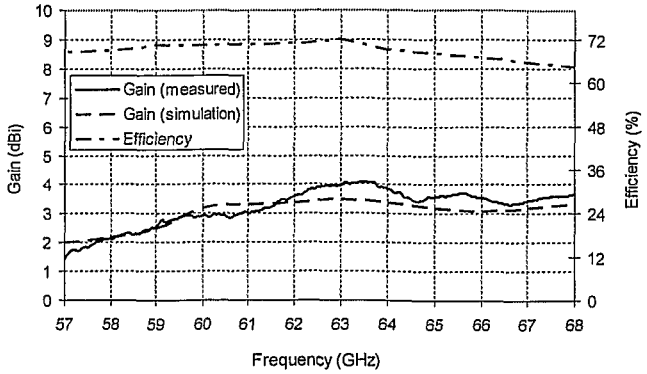
FIG. 8 illustrates measured gain and radiation efficiency of an integrated microstrip antenna with flip-chip interconnect. (Simulation parameters: h=40 μm, $\in_r$=4.1, bump diameter=60 μm)

FIG. 8 shows the measured gain, simulated gain and efficiency. The gain was measured at angle of $\theta=0°$ and $\phi=0°$ (FIG. 3*a*). The measurement set-up was calibrated using coaxial calibration kit and V-band horn antennas [12]. Then, one port is connected to a GSG probe (calibrated at the tips) and a test antenna and the other port to the horn antenna. The fabricated antenna achieves a gain of 2-4 dBi inside the −10 dB impedance bandwidth at $\theta=0°$. This level of gain is low, however, an array can be formed by a number of these antenna elements to enhance the radiation and compensate the path loss for 60-GHz radio.

The results of FIGS. 3 to 8 show that a wide antenna bandwidth can be achieved with very short bumps and thin underfill layer 114 at the expense of decreased efficiency and gain. Bump diameter variations, provided they are within acceptable tolerance, don't affect the bandwidth, gain or efficiency. The low permittivity of the underfill layer 114 increases gain and efficiency but only slightly reduces the bandwidth. Thus, a standard and inexpensive flip-chip bonding process can be used to achieve antenna-die integration even for a challenging wide bandwidth such as the 57-64 GHz band, provided that careful consideration is given to flip-chip parameters (e.g. bump size and tolerance) during the antenna design stage.

This embodiment of the invention thus enables a wireless transmitter system with wide bandwidth and high efficiency that can be achieved with simple structure and low cost standard fabrication processes. In turn, the invention provides for antenna integration with millimeter-wave transceiver circuits using low cost standard printed circuit technology and flip-chip bonding. The flip-chip interconnection allows on-chip mounting of the antenna element 100 and effects a smooth transition from the antenna CPW feeding line 108 to microstrip transmission line 118 or device on the CMOS die 120. Unlike a wire bonding attachment, the flip chip mounting results in low reflections and wide operational bandwidth at millimeter-wave frequencies.

Figure 9A:
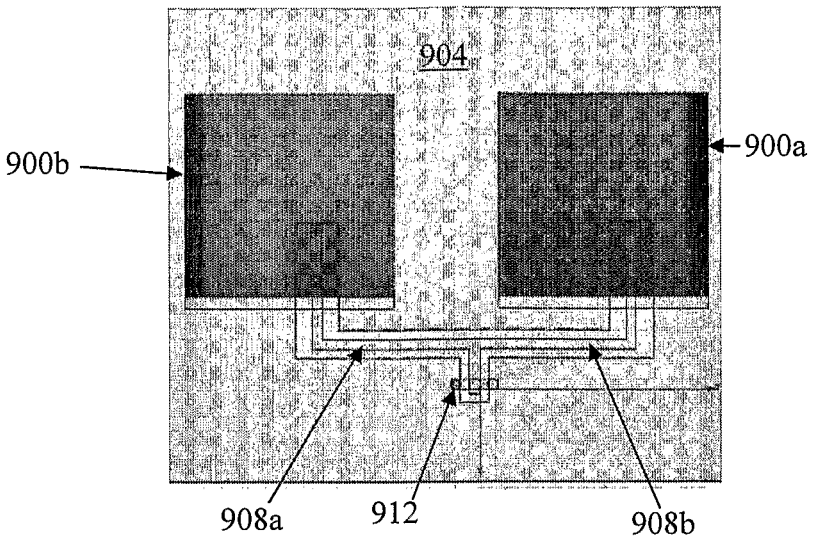
FIGS. 9*a* and 9*b* are separate layer views of a second embodiment of the invention comprising a two element antenna array connected to a signal feed by a split coplanar waveguide flip chip bonded to a CMOS die.
Figure 9B:
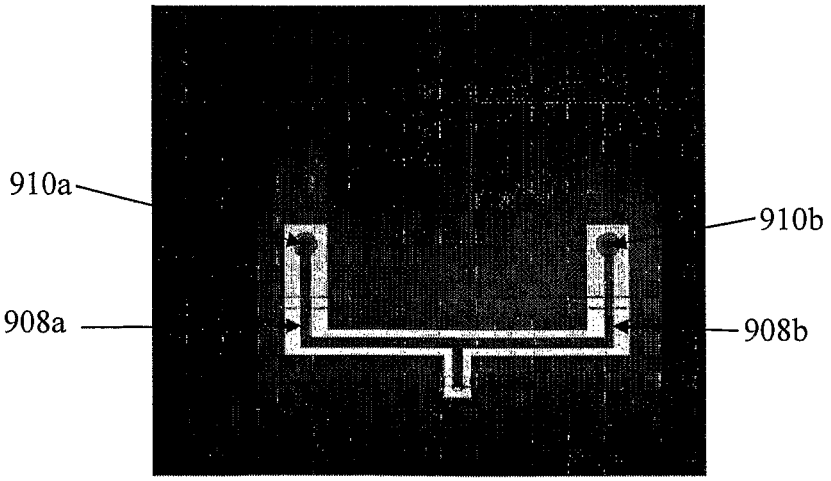

In other embodiments of this invention, an antenna array can be fabricated by connecting two or more antenna elements of this type and integrating them with the CMOS die using the flip-chip bonding technique to connect each antenna. FIGS. 9*a* and 9*b* show an embodiment comprising an array of two antenna elements 900*a*, 900*b* mounted on the top side of a single substrate 904 and each connected with a coplanar waveguide line 908*a*, 908*b* on the under side of the substrate 904. The CPW 908*a*, 908*b* extend from a respective via 910*a*, 910*b* connected to each antenna 908*a*, 908*b*, from where the CPW 908*a*, 908*b* extend to join each other, and then extend to a single set of metallic bumps 912 for flip chip mounting. A single flip chip connection may then be used to bond the joined CPW to a CMOS die using the metallic bumps 912 and thermo-sonic attachment. Alternative embodiments having multiple antennas may provide a dedicated CPW and set of bumps for each antenna element, for example to permit phased array operation and beam steering.

Figure 10A:
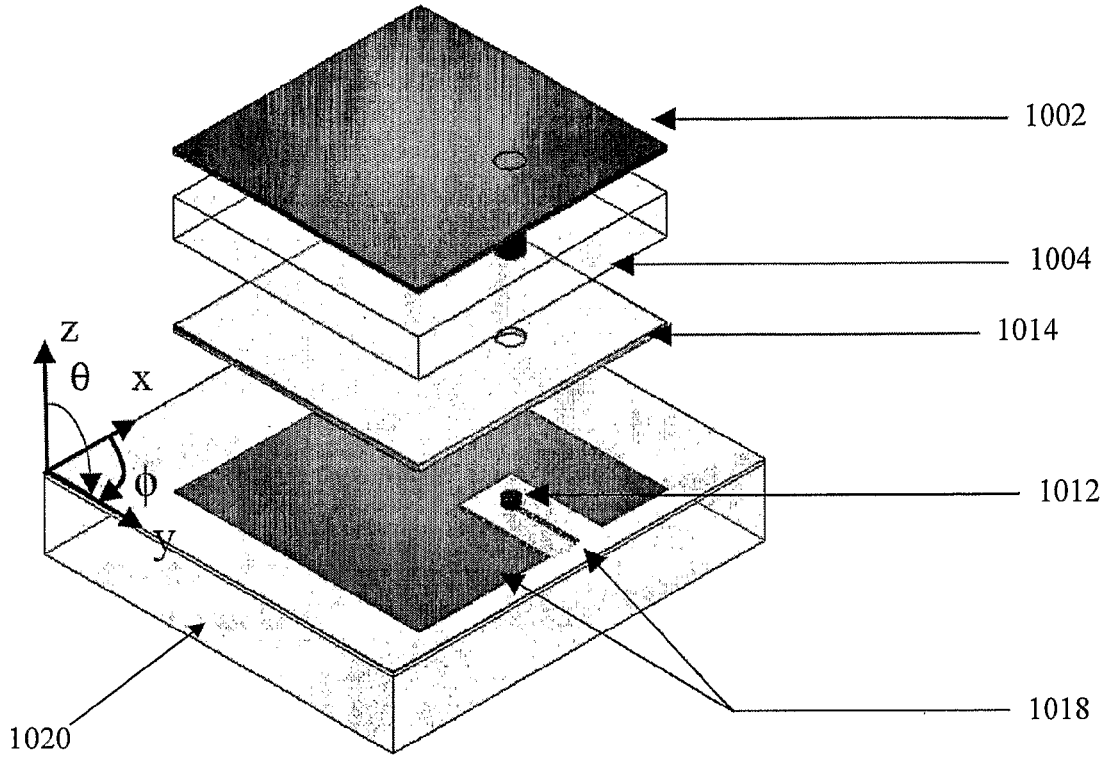
FIG. 10*a* is a perspective view.
Figure 10B:
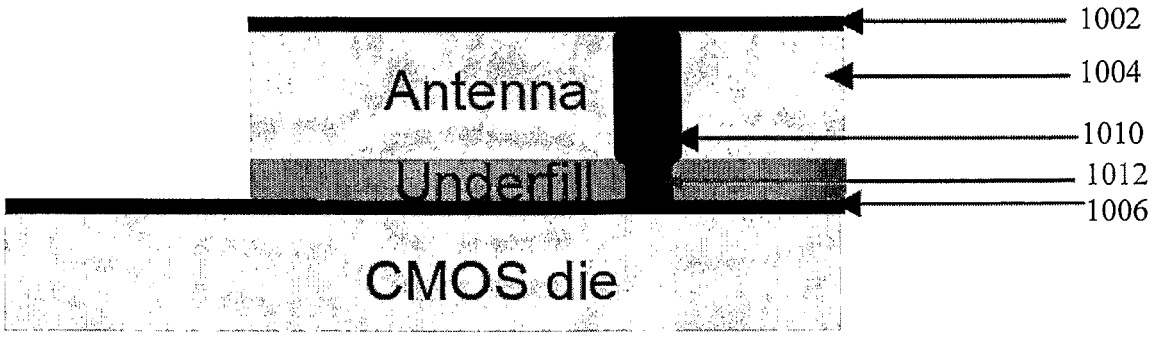
FIG. 10*b* is a cross sectional side view, of a further embodiment of the invention.

FIG. 10*a* is a perspective view, and FIG. 10*b* is a cross sectional side view, of an antenna 1000 in accordance with a further embodiment of the invention. In this embodiment the substantially square radiating antenna patch 1002 is once again mounted upon a substrate 1004, with a via 1010 extending from the patch 1002 through the substrate 1004. However, in this embodiment, the substrate 1004 does not comprise a ground plane and is flip chip mounted upon a CMOS die with an interposed underfill layer 1014. In this embodiment the ground layer 1006 is instead formed upon the CMOS die 1020, and is interrupted by the CMOS coplanar waveguide feed 1018, which terminates in metallic bump 1012. The via 1004 is bonded to the bump 1012 by thermo-sonic attachment.

This invention thus provides for an on-chip antenna design which allows flip chip bonding to form an integrated RF system (RFIC) in a single package, offering the potential for substantially reduced manufacturing cost of transceivers in the millimeter wave domain, for example the 57-64 GHz band. The digital part of the transceiver can also be integrated on the same chip. The on chip antenna is further fabricated using standard PCB technology and a single substrate for the antenna element, and permits multiple antenna arrays to be fabricated. Appropriately designed antenna feeds and antenna shape provide for a suitably broad bandwidth of the antenna, with high efficiency for such substrates.

The present invention notably selects flip chip interconnection. This is in recognition that bonding wire (wire bonding or wedge bonding), while typically employed to connect passive devices such as antennas to chip modules, increases impedance mismatches and power losses at millimeter wave frequencies and requires insertion of compensation networks and accurate electromagnetic modelling of transition discontinuities. The present invention recognises that the parasitic effects of transition discontinuities in millimeter wave systems can be significantly reduced by employing flip-chip bonding to connect the antenna to the die. Testing of the embodiment of FIGS. 1 and 2 shows that microstrip antenna bandwidths of 15% can be achieved with careful flip-chip interconnection design and fabrication. This is of particular importance for the integration of millimeter wave antennas into the CMOS package which are suitable for operation in the 57-64 GHz band.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A monolithic antenna element comprising:

a microstrip patch antenna formed on a first surface of a substrate;

a ground plane formed on or adjacent to a second surface of the substrate substantially opposite the first surface, such that, the substrate is between the patch antenna and the ground plane;

a feeding via extending from the second surface through the substrate to the first surface and being electrically connected to the microstrip patch antenna in a location distal from lateral edges of the microstrip patch antenna; and a coplanar waveguide feed line formed on or adjacent to the second surface of the substrate and interrupting and being electrically distinct from the ground plane, and extending from proximal to a lateral edge of the second surface to the feeding via, wherein the coplanar waveguide feed line is formed to connect with a feed line on a CMOS die such that the substrate is flip chip mountable entirely upon the CMOS die.

2. The monolithic antenna element of claim 1 wherein the patch antenna is substantially square shaped to provide circular polarization.

3. The monolithic antenna element of claim 1 wherein a location at which the feeding via is connected to the patch antenna is predetermined in a manner to effect input impedance matching.

4. The monolithic antenna element of claim 1, wherein the patch antenna is substantially square shaped to provide circular polarization, and wherein impedance matching is effected by locating the feeding via substantially upon one diagonal of the patch antenna.

5. The monolithic antenna element of claim 1, wherein the ground layer is formed on the second surface of the substrate, prior to flip chip mounting of the substrate upon a CMOS die.

6. The monolithic antenna element of claim 1, wherein the ground layer is formed on a CMOS die and positioned adjacent to the second surface of the substrate by flip chip mounting of the substrate upon the CMOS die.

7. A monolithic transceiver comprising at least one antenna element in accordance with claim 1 flip chip mounted upon, a CMOS die.

8. The monolithic transceiver of claim 7, wherein a size and position of metallic bumps upon the CMOS die provided to effect a flip chip interconnect with the antenna element are selected in order to optimize the antenna characteristics for an intended purpose.

9. The monolithic transceiver of claim 7 comprising a plurality of antenna elements in accordance with claim 1 flip chip mounted upon the CMOS die.

10. The monolithic transceiver of claim 9 wherein a single set of bumps is provided to feed all of the antenna elements.

11. The monolithic transceiver of claim 9 wherein a plurality of sets of bumps is provided, each set feeding a respective antenna element.

12. A method of fabricating a monolithic antenna element, the method comprising:

forming on a first surface of a substrate a microstrip patch antenna;

forming on or adjacent to a second surface of the substrate substantially opposite the first surface a ground plane, such that the substrate is between the patch antenna and the ground plane;

forming a feeding via extending from the second surface through the substrate to the first surface and being electrically connected to the microstrip patch antenna in a location distal from lateral edges of the microstrip patch antenna; and forming on or adjacent to the second surface of the substrate a coplanar waveguide feed line interrupting and being electrically distinct from the ground plane, and extending from proximal to a lateral edge of the second surface to the feeding via, wherein the coplanar waveguide feed line is formed to connect with a feed line on a CMOS die such that the substrate is flip chip mountable entirely upon the CMOS die.

13. The method of claim 1 wherein the patch antenna is substantially square shaped to provide circular polarization.

14. The method of claim 12 wherein a location at which the feeding via is connected to the patch antenna is predetermined in a manner to effect input impedance matching.

15. The method of claim 12, wherein the patch antenna is substantially square shaped to provide circular polarization, and wherein impedance matching is effected by locating the feeding via substantially upon one diagonal of the patch antenna.

16. The method of claim 12, wherein the ground layer is formed on the second surface of the substrate, prior to flip chip mounting of the substrate upon a CMOS die.

17. The method of claim 12, wherein the ground layer is formed on a CMOS die and positioned adjacent to the second surface of the substrate by flip chip mounting of the substrate upon the CMOS die.

* * * * *